United States Patent [19]

Ellis

[11] Patent Number: 4,984,619

[45] Date of Patent: Jan. 15, 1991

[54] FREE STANDING BABY GATE

[76] Inventor: Larry R. Ellis, 1098 Highland Dr., St. Albans, W. Va. 25177

[21] Appl. No.: 381,792

[22] Filed: Jul. 19, 1989

[51] Int. Cl.[5] ..... A47G 5/00

[52] U.S. Cl. ..... 160/351; 49/463; 256/73; 256/20

[58] Field of Search ..... 160/351, 225; 256/73, 256/26; 292/246; 49/463, 388

[56] References Cited

U.S. PATENT DOCUMENTS 4,568,120 2/1986 Hoffman ..... 297/134 X 4,723,587 2/1988 Scruggs, Jr. ..... 160/136

*Primary Examiner*—Blair M. Johnson

[57] ABSTRACT

A free-standing, self-supporting baby gate consisting of: a gateframe composed of two posts adapted to rest on opposite ends of a top stair and connected by a horizontal beam at the level of the horizontal plane of the top of the stairway; a flat, rigid mat, hinged to the beam connecting the two gateposts and adapted to rest on the floor at the top of the gateframe; a barrier which is hinged to one of the posts and latches to the other and; braces which are pivotally attached to each post and which rotate toward and lock against the mat.

1 Claim, 1 Drawing Sheet

FREE STANDING BABY GATE

BACKGROUND OF THE INVENTION

The invention is a free-standing, self-supporting baby safety gate. This device is designed to safely obstruct an infant's approach to a down stairway, without being mechanically attached to floor, walls, balusters, or stair rails.

TECHNICAL FIELD

There are several types of baby safety gates in the art: the lazy-tong expansible gate, as illustrated in the following U.S. Pat. Nos. 4,523,745, and 4,723,587; gates which are held into place through a wedging, jamming, or pressure action, as illustrated in U.S. Pat. Nos. 4,492 263, and 3,431,966 .

There are various problems associated with each of the baby gates now in the art. An inevitable concern with each is the integrity of the attachment of the gate to the wall, baluster, or stair-rail. If an attaching nail or screw loosens or weakens a hazard is created. A gate which is dependant on pressure against a vertical surface, such as a wall or baluster may fail for several reasons: fatigue in springs or pressure bearing joints; an erosion of the friction or gripping quality of the surfaces which press against the wall or baluster; further, many walls and balusters are not perfectly fixed and may move or compress in response to the pressure of the gate, thus reducing the pressure and therefore the integrity of the barrier. Such hazards may be nearly imperceptible. Moreover, there are many staircase designs that will not accommodate these traditional gates. Finally, and less importantly, attachment of many of the available gates, particularly those which are affixed by wedging or , may result in cosmetic damage to plaster walls or exposed hardwood. Installation and removal of many of the old-style gates also involves some drilling, hammering, and measuring.

SUMMARY OF THE INVENTION

It is therefore an object of this invention to provide a baby gate that obstructs a down stairway without being mechanically attached to walls, balusters, or stair-rails.

The invention consists of a vertical gate-frame make up of posts which test on opposite ends of the top stair, and are connected by a horizontal beam, a rigid, horizontal "mat" which is hinged to the horizontal beam of the frame and which lies flat on the floor at the top of the stairway, and a gate which is hinged vertically to one of the posts of the frame and latches to the other. The gate functions as an obstacle by using the infant's weight against the infant. That is, the infant cannot reach the vertical plane of the gate without putting his full body weight on the horizontal plane of the gate. The infant also is prevented from pulling the gate back on himself by locking braces which are attached (one to a side) to the posts of the gate frame and which lock against the mat. Thus, as the infant approaches the vertical plane, the unit becomes a fixed obstacle. The unit as designed presents minimal impedance to adult traffic and is portable.

DESCRIPTION OF THE PREFERRED EMBODIMENT

Figure 1:
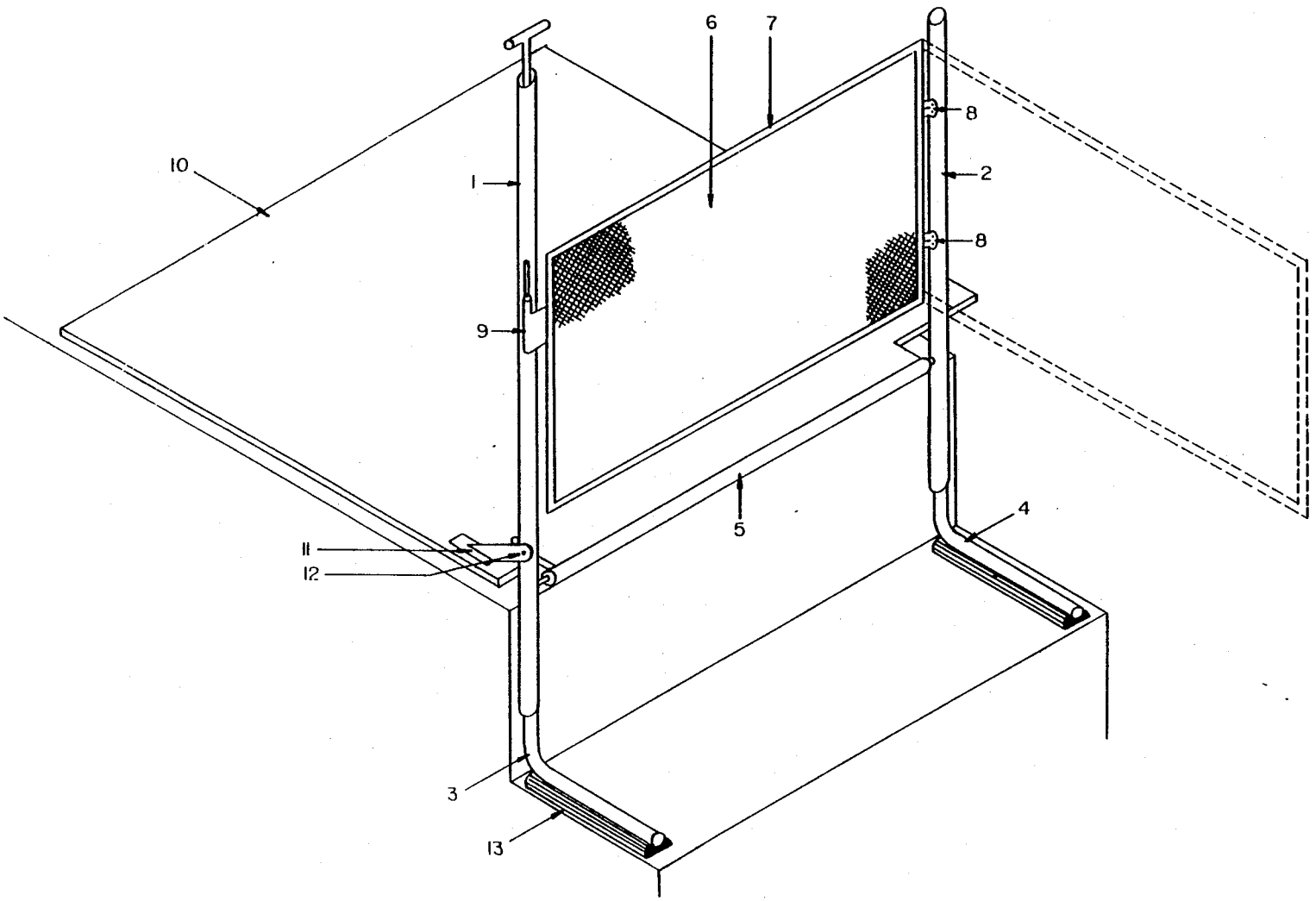
FIG. 1 is an isometric view of the invention in its closed position blocking entrance to a stairway.

Referring now to the drawing in more detail, FIG. 1 shows the unit in isometric view. The vertical plane of the gate consists of tubular metal posts 1 and 2, each of which is supported by a horizontal base 3 and 4, which rest on the top stair, a horizontal beam 5 which runs between the uprights 1 and 2 and to which the mat or horizontal plane of the unit is hinged; and the gate itself which consists of nylon mesh 6, stretched over a tubular metal frame 7. The gate is hinged to one of the posts and latches to the other.

The horizontal plane of the unit consists of a rigid mat 10, that is hinged to the horizontal beam running between the two posts 1 and 2. The mat should be no more than one-fourth (¼) inch thick so as to minimize impedance of adult traffic. It should be as wide or wider than the staircase and should extend away from the gate at least thirty (30) inches. The mat is hinged to the horizontal beam to allow the unit to collapse for storage.

The locking brace mechanism functions to prevent an infant from pulling the gate back on himself. The locking brace 11 is a metal strip that is pivotally (pivot connection 12) connected to each post and which rotates toward and locks against the mat.

The bases which support the posts should also be made from tubular metal and should fit snugly into the uprights in an arm-in-sleeve manner. The horizontal bases should rest on and be connected to 13 soft rubber pads adapted to sit on the top stair.

What is claimed is:

1. A free-standing gate and gate frame adapted to fit at the top of a stairway, comprising:

(a) a gateframe consisting of two vertically oriented posts, adapted to rest on respective lower ends thereon a top stair and, which are supported by horizontal feet located on said lower end which rest on the top stair, a horizontal beam extending between said posts at a location above said feet a distance substantially equal to the distance between the top stair and the floor at the top of the stairway with the major portion of said posts extending above said horizontal beam.

(b) a rigid generally planar mat which is a adapted to the floor at the top of the stairway and is hinged to said beam running between the two posts, (c) a movable gate which is hinged to one of the posts, and which latches to the other post, (d) braces which attach pivotally to the posts and are adapted to rotate toward and lock against the rigid mat, (e) means pivotally connecting the braces to the posts, (f) means locking the braces against the mat, (g) means hinging said mat to gateframe, (h) means hinging said movable gate to a post of said gateframe, and (i) means latching said movable barrier gate to the other post of said gateframe.

* * * * *